United States Patent [19]

Creamer

[11] 3,936,896

[45] Feb. 10, 1976

[54] BUOYANT SHOE

[76] Inventor: Adelene Creamer, 137 Palmer Ave., Mountain View, Calif. 94040

[22] Filed: June 5, 1972

[21] Appl. No.: 260,006

Related U.S. Application Data

[63] Continuation of Ser. No. 877,351, Nov. 17, 1969, abandoned.

[52] U.S. Cl. ..... 9/310 D; 9/309

[51] Int. Cl.[2] ..... A63C 15/00

[58] Field of Search ..... D2/264–283; 9/309, 310 D; 36/2.5 R, 8.1 R, 7.1 R, 2.5 A–2.5 W

[56] References Cited

UNITED STATES PATENTS

| | | | |
|---|---|---|---|
| 1,973,292 | 9/1934 | Littell et al. | 36/8.1 |
| 3,373,512 | 3/1968 | Jacobson | 36/7.1 R |
| 3,417,415 | 12/1968 | Kozak | 9/309 |
| D154,501 | 7/1949 | Marx | D2/274 |

FOREIGN PATENTS OR APPLICATIONS

| | | | |
|---|---|---|---|
| 1,364,921 | 5/1964 | France | 9/309 |

OTHER PUBLICATIONS

*American Shoemaking,* Oct. 12, 1955, p. 27. "Squeeze-Bottle Plastic Clog-Hoppers".

*Primary Examiner*—Trygve M. Blix
*Assistant Examiner*—Paul E. Sauberer
*Attorney, Agent, or Firm*—Townsend and Townsend

[57] ABSTRACT

A shoe of lightweight, buoyant material adapted to be loosely worn on the foot below water level to cause the walking movements of the wearer to simulate those of an astronaut walking on the moon. The shoe can have a sole and toe design to simulate the footwear of an astronaut or the foot of an animal.

1 Claim, 7 Drawing Figures

FIG. 1
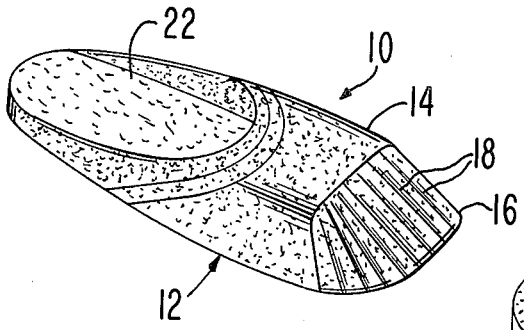
FIG. 4
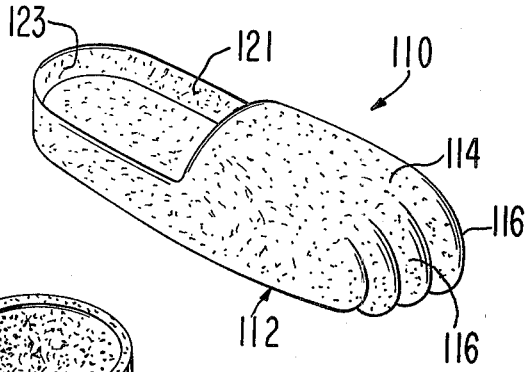
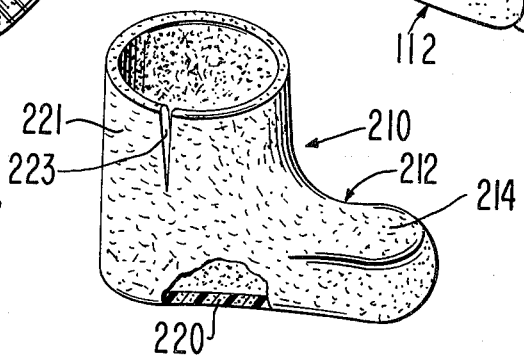
FIG. 7
FIG. 2
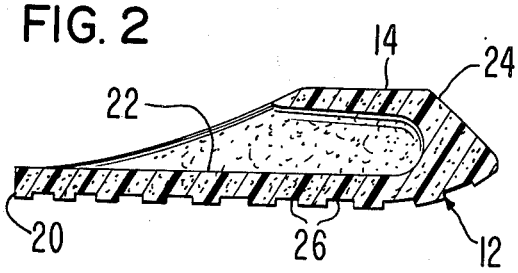
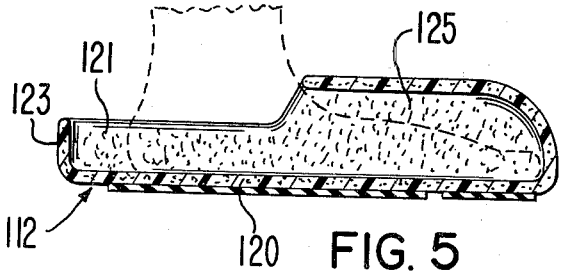
FIG. 5
FIG. 3
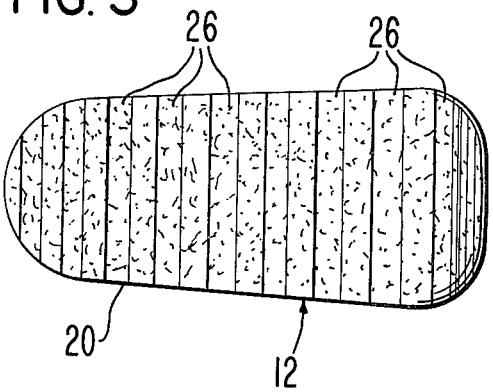
FIG. 6
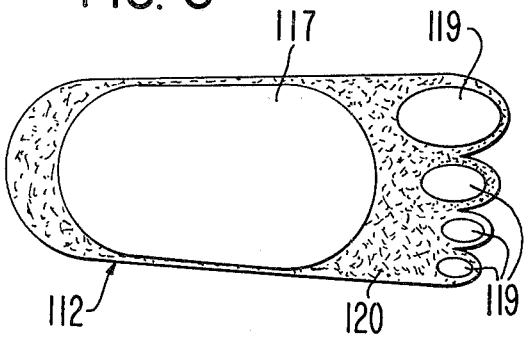
INVENTOR.
ADELENE B. CREAMER
BY Townsend and Townsend
ATTORNEYS

BUOYANT SHOE

This is a Continuation of Ser. No. 877,351, filed Nov. 17, 1969, now abandoned.

This invention relates to improvements in accessories worn in and around swimming areas and, more particularly, to a shoe of lightweight, buoyant material.

The present invention is directed to a shoe adapted to be loosely worn on the foot in a swimming pool or the like. The shoe is made of a lightweight, buoyant material, such as styrofoam, expanded plastic or the like and preferably is of a one-piece construction to minimize production costs and to provide a rugged, one-piece unit. The material of the shoe is sufficiently buoyant to permit the wearer, when wearing shoes on both feet, to simulate the walking movements of an astronaut on the moon or other planets whose gravitational effects are different from those on the earth. Thus, the user walking in the water will bob or spring up and down while moving forwardly, such movements providing a physical sensation which is not achieved when walking in the water in the normal manner.

Another aspect of the invention is the way in which the shoe is made so as to render it safe for use in the water. The major portion of the buoyant material of the shoe is in the front part of the shoe and the foot is loosely received therein when the shoe is worn. Thus, the shoe will float off the foot unless the user is standing or is otherwise erect. The shoe will, therefore, not cause instability of the user in the water.

A further aspect of the shoe of this invention is that it can be made with particular toe and sole designs to simulate the toe and sole portions of footwear worn by astronauts or to simulate the foot of an animal. Such designs will stimulate the interest of children and others in wearing the shoe and to use the same for the purpose described above as well as to cause distinctive footprints to be formed in loose soil or sand when walking to and from the water in which the shoe is to be used.

The primary object of this invention is to provide a shoe of lightweight, buoyant material which is adapted to be loosely worn on the foot to permit the wearer to walk through water in a spring-like fashion yet the shoe will not be so buoyant to cause the person to be rendered unstable in the water.

Another object of this invention is to provide a shoe of the type described which is of a simple, rugged, one-piece construction capable of being molded in different sizes or with different amounts of buoyant material to minimize production costs while permitting the shoe to be made with well-known molding techniques.

A further object of the invention is to provide a show of the aforesaid character which can be provided with specific toe and sole designs to provide a representation of either the footwear of astronauts or the foot of an animal so that specific footprints can be made in loose soil or sand when the shoe is worn to and from the water in which the shoe is used.

Still another object of the invention is to provide a shoe of the type described which can be made in the form of a boot which is capable of achieving the purpose set forth above with respect to the use of the shoe in water while, at the same time, the boot can be used for walking during rainy conditions or walking in snow so as to keep the feet or shoes dry and to provide some thermal insulation therefor.

Other objects of this invention will become apparent as the following specification progresses, reference being had to the accompanying drawing for illustrations of several embodiments of the shoe.

In the drawings:

FIG. 1 is a perspective view of one embodiment of a buoyant shoe made in accordance with the teachings of this invention;

FIG. 2 is a vertical cross section of the shoe of FIG. 1;

FIG. 3 is a bottom plan view of the shoe;

FIG. 4 is a perspective view of a second embodiment of the shoe;

FIG. 5 is a vertical cross section of the shoe of FIG. 4 showing the same mounted on a foot;

FIG. 6 is a bottom plan view of the shoe of FIG. 4; and

FIG. 7 is a perspective view of a third embodiment of the shoe made in the form of a boot.

A first embodiment of the shoe of this invention is denoted by the numeral 10 and includes a body 12 of lightweight, buoyant material, such as styrofoam, expanded plastic or the like. Body 12 is of a one-piece construction and includes an upper 14 which can be of any shape but, for purposes of illustration, it is oval shaped and has a front end 16 provided with a suitable design, such as a number of forwardly extending ribs 18 or the like to simulate the configuration of an actual article of footwear, such as the toe portion of an astronaut's boot or shoe. Such design can also simulate an animal's foot as will be described hereinafter. In any case, the design can be easily incorporated in the shoe and can be relied upon to stimulate the interest of children and grownups alike in acquiring and wearing the shoe for the purpose hereinafter set forth or for other purposes as well.

Upper 14 is integral with a sole 20 which has an upper surface 22 for engaging the sole of the foot when the front part of the foot is inserted into the space 24 between upper 14 and sole 20. Shoe 10 is backless so as to form a slipper which permits shoe 10 to be easily separated from the foot, such as when the shoe floats off the foot in water.

The bottom of sole 20 has a number of shallow, transverse grooves 26 therein which provides a distinctive pattern in the footprint made by the shoe when the latter is worn when walking on wet sand or loose soil. Also, the grooves provide a specific design, such as the footprints of an astronaut on the surface of the moon. Thus, the shoe will, when worn by children, for instance, be the source of delight for the wearer in the sense that he will be able to form footprints which very closely resemble those formed on the surface of the moon and other planets by astronauts.

Shoe 10 is adapted to be worn on the foot below water level in a body of water, such as a swimming pool or the like. The amount of buoyant material in the shoe is such that the shoe has some buoyant effect on the user. Since the shoe is worn on the lowermost extremity of the user when the latter is standing or is otherwise erect in the water, the shoe on one foot, in conjunction with another and identical shoe on the other foot, will cause the user, when walking through the water, to bob up and down at a rate which is less than normal. The bobbing or springing movements of the user will, in effect, simulate very closely the walking movements of an astronaut on the moon or other planet whose gravitational force is less than that of the earth.

The shoes, when worn in the manner described above, are safe in the sense that they will not remain on the wearer unless the latter is in a standing position. If the wearer tends to topple to the side, the shoes will come off since they will generally be larger than the feet and also are backless to permit ready removal from the foot. Also, the major portion of the buoyant material is in the toe portion of the shoe so that the user can tilt the foot upwardly to cause the shoe to slip off and float to the surface of the water.

The shoes can be made in different sizes and are preferably molded to provide the one-piece construction of body 12. Molding is also preferred to reduce production costs by the use of well-known molding techniques. The thickness of upper 14 is shown as substantially the same as that of sole 20. This feature will provide the buoyancy capabilities described above. Increased buoyancy effects can be achieved by, for instance, increasing the thickness of the sole in the vicinity of upper 14. Moreover, the shoe can be made for users in specific weight ranges. For instance, one shoe can be made for children in the weight range of 30–60 lbs; another shoe can be made for the weight range of 70–100 lbs; a third shoe can be made for the weight range of 110–150 lbs, and so on. For the greatest safety of the user, the space in the shoe for receiving the foot could be the same size in all such shoes with the difference between the shoes being in the amount of buoyant material used. Thus, the shoe would still float off the foot if a large user were to use the shoe for the 30–60 lb. range.

Another embodiment of the invention is illustrated in FIGS. 4–6 and includes a shoe 110 having a body 112 provided with an upper 114, a sole 120, a pair of spaced sides 121 and a back 123 interconnecting sides 121. Shoe 110 is made from lightweight, buoyant material of the type described above in a one-piece construction and generally is oversized to permit the foot 125 of the wearer to be loosely received within the shoe, such that the heel of the foot will generally be forwardly of the back 123.

Thus, when the shoe is worn in the water, the shoe will separate from the foot unless the wearer is in a standing position. Shoe 110 also provides a buoyancy to the wearer when the latter is walking in water and, when so walking, the wearer will bob up and down as described above with respect to shoe 10 to simulate the walking movement of an astronaut on the moon or other planet.

Shoe 110 can have an animated design on the toe portion and on the underside of sole 120. For purposes of illustration the front portion of body 112 is provided with a number of convex, toe-like enlargements 116 to simulate the toes of an animal. Also, surface extensions 117 and 119 can be provided on the bottom of sole 120 to simulate the bottom of the foot and toes of an animal. Thus, the surface extensions will cause a distinctive animal-like footprint in loose soil or sand when the wearer walks across the same.

A third form of the shoe of this invention is broadly denoted by the numeral 210 and is shown in FIG. 7. Shoe 210 is in the form of a boot having a body 212 provided with an upper 214, a sole 220 and a tubular extension 221 integral with upper 214 to provide the boot-like character for the shoe. A narrow V-shaped slit 223 is formed in one side of shoe 210. The shoe is made from lightweight buoyant material of the type described above and is preferably a one-piece construction wherein upper 214, sole 220 and extension 221 are formed simultaneously with each other in any suitable manner, such as in carrying out a molding process. Also, the V-shaped slit 223 can be formed during the molding process and is provided to permit some flexibility of extension 221 to facilitate the insertion of the foot in the shoe if such is deemed necessary. Generally, however, the shoe will be oversized to permit the foot of the wearer to be loosely received therewithin. Thus, when the shoe is worn in the water, the shoe will readily separate from the foot inasmuch as the major portion of the buoyant material is in the front part of the shoe. Shoe 210, like shoes 10 and 110, provides a buoyancy to the wearer when the latter is walking in water so that the wearer will bob up and down as described above with respect to shoes 10 and 110 to simulate the walking movement of an astronaut on the moon or other planet.

Shoe 210 can have toe and sole designs in the manner described above with respect to the other two embodiments of the invention. In addition, shoe 210 can be worn during rainy conditions or can be worn while walking through snow. The shoe may be sufficiently oversized to permit the street shoe of the wearer to be inserted therewithin. Thus, the foot and street shoe, when worn in shoe 210, can be kept dry and essentially thermally insulated. Moreover, it is contemplated that shoe 210 can be disposable after a single use in this manner or after use over a particular period of time.

I claim:

1. An article of footwear to be loosely worn directly on the foot in a body of water comprising: a backless, strapless shoe having an upper and a sole integral with each other, the rear margin of the sole defining the rearmost structure of the shoe, said upper being spaced forwardly of said rear margin, said upper and said sole defining a space for receiving the front part of the foot, said upper and sole being formed from a lightweight, buoyant, expanded plastic material in sufficient amount to increase the buoyancy of the wearer in a body of water and to permit the wearer, when wearing a second, identical shoe to floatingly walk in the water and to bob up and down in the water while walking therethrough and while the shoe remains below the upper level of the water said shoe being easily releasable from the foot in case of the wearer's emergency.

* * * * *